United States Patent [19]

Roy et al.

[11] 4,316,163

[45] Feb. 16, 1982

[54] THERMAL-MAGNETIC CIRCUIT BREAKER

[75] Inventors: Nilendu Roy, Stafford; Arnold Horton, Essington, both of England

[73] Assignee: Federal Pacific Electric Company, Newark, N.J.

[21] Appl. No.: 910,786

[22] Filed: Jun. 22, 1978

[51] Int. Cl.[3] ..... H01H 75/12

[52] U.S. Cl. ..... 335/37; 335/43; 337/75

[58] Field of Search ..... 335/37, 36, 35, 23, 335/43 X, 14; 337/75

[56] References Cited

U.S. PATENT DOCUMENTS

| | | | |
|---|---|---|---|
| 2,631,208 | 3/1953 | Page | 335/37 |
| 2,842,635 | 7/1958 | Cole | 335/37 |
| 2,854,546 | 9/1958 | Cole | 335/37 |
| 2,876,309 | 3/1959 | Wiktor | 335/37 |
| 3,134,871 | 5/1964 | Norden | 335/37 |
| 3,784,940 | 1/1974 | Torre | 335/43 |

*Primary Examiner*—Harold Broome

*Attorney, Agent, or Firm*—Ronald R. Stanley; Roy F. Hollander

[57] ABSTRACT

The present invention relates to circuit breakers of a particular class, namely, the type in which a toggle is manually erected to drive a "heart" as a unit for closing the circuit breaker. The "heart" includes a contact arm, an actuator, and overcurrent releasable latch means which collectively form a normally latched unit. Under excess-current conditions, the latch means releases the actuator, and contact arm then opens the circuit.

The latch means includes a conventional bimetal fixed at one end to the contact arm. The bimetal carries a pivoted latch lever, and is surrounded by a core-and-armature unit adjacent its secured end, for operating the latch lever in response to high overcurrents. High magnetic trip sensitivity is achieved in a construction wherein the whole electromagnet moves with the contact arm, without resort to a current-carrying coil for the electromagnet.

2 Claims, 3 Drawing Figures

THERMAL-MAGNETIC CIRCUIT BREAKER

FIELD OF THE INVENTION

The present invention relates to thermal-magnetic circuit breakers.

BACKGROUND

The particular class of circuit breaker of present concern is a well-known type involving a manually operated toggle that drives a pivoted "heart" in closing the circuit breaker. The toggle becomes erect and slightly over-set to lock the "heart" in closed condition, but the heart itself incorporates overcurrent releasable latch means that allows the breaker to open despite the locked condition of the toggle. The "heart" includes three main parts: an elongated contact arm, an actuator, and an overcurrent latch device. The heart is operable as a unit about a pivot roughly midway between the ends of the contact arm. The actuator is pivoted to one end of the contact arm. The opposite end of the contact arm carries the movable contact of the circuit breaker. An elongated bimetal forming part of the overcurrent release device has one end secured to the contact arm near the movable contact. The bimetal carries a pivoted latch that normally obstructs the actuator, the heart constituting a latched unit in this condition. Deflection of the bimetal due to heating by circuit breaker current carried by the bimetal shifts the latch in the release direction. Associated with the bimetal is an electromagnet that also can operate the latch in the release direction.

Various forms of the toggle-and-"heart" type of circuit breaker are shown in the prior art, conforming to all of the above description. In the past, it has always seemed necessary to incorporate a coil with the core or yoke and the armature whenever a sensitive magnetic trip was desired. Notably, in many cases, most if not all of the structure forming the thermal and magnetic trip elements move bodily with the contact arm when the circuit breaker closes and when it is opened either manually or automatically. That basic requirement of a bodily movable thermal-magnetic trip device inherently has constraints in the way of achieving practical and economical circuit breakers of the type.

SUMMARY OF THE INVENTION

An object of the invention is to provide a novel toggle-and-heart circuit breaker having a practical and economical overcurrent release device including thermal and sensitive magnetic release means.

In achieving this purpose, the novel circuit breaker has a release device that utilizes the usual elongated bimetal secured at one of its ends to the movable contact arm. Fixed to the heart near the secured end of the bimetal is the core of an electromagnet, the core extending across the bimetal between the bimetal and the contact arm. The armature extends across the opposite side of the bimetal. A latch lever extends along the bimetal and has a medial pivot carried by the bimetal at a position relatively remote from the secured end of the bimetal. When the bimetal is heated, its deflection causes shift of the latch-lever pivot in the tripping direction. The armature of the electromagnet, when shifted magnetically toward its core, drives the latch lever in the tripping direction. The construction has proved highly effective for its intended purpose, and it avoids complexity and is economical to produce.

An illustrative embodiment of the invention is shown in the accompanying drawings and described below. That embodiment is evidently susceptible of a range of modification within the spirit and scope of the invention.

Figure 1:
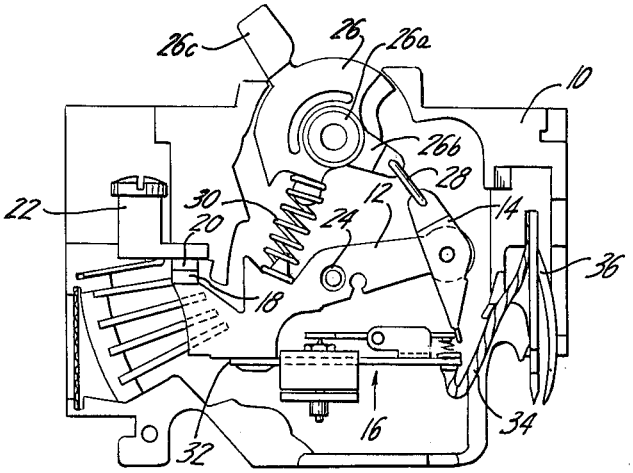
FIG. 1 is a lateral view of an illustrative circuit breaker embodying the various features of the invention, the front cover of the molded-case enclosure being removed to reveal the internal mechanism.

In FIG. 1, the illustrative circuit breaker has a case 10 of molded insulation whose cover has been removed to reveal the internal parts. The illustrative mechanism is one of a widely used distinctive type, which includes a "heart" consisting of three principal parts and a toggle. The "heart" includes an elongated contact arm 12 as of copper, a pivoted actuator 14, and an over-current release device 16 that forms a latch for the actuator when the circuit breaker is closed (and while it is being closed) and which releases actuator 14 in response to an overcurrent or a short-circuit for enabling the circuit breaker to open. The mechanism is shown in the closed condition of the circuit breaker. Movable contact 18 as of silver-tungsten is united to the end of contact arm 12 that is remote from actuator 14. Movable contact 18 is in engagement with companion contact 20, also of silver-tungsten, fixed to terminal 22. This companion contact 22 in some forms of this type of breaker is capable of limited motion, and in those breakers this contact is spring-biased toward the movable contact. Approximately at its mid-point, contact arm 12 is supported on a transverse pivot 24 whose ends are supported in the cover and the case of molded-case enclosure. Where contact 20 is fixed, (as here) this pivot takes the form of a tightly wound coil spring that resembles a rod, with its ends supported in the cover and the case, and with contact arm 12 carried at the mid-point along the length of this coil spring. In those circuit breakers of this class where contact 20 is spring-biased, pivot 24 is normally a rigid pin.

A manual operating mechanism is provided for actuating the three-part unit or "heart" 12, 14, 16 into the closed configuration illustrated. This includes a handle 26 as of molded insulation having aligned oppositely extending pivot portions **26*a* received in bearings of the molded case and cover. A link 28 is articulated to arm 26*b* of the handle and to actuator 14. This link 28 here is a U-shaped piece of wire whose legs are received in bearings formed in actuator 14 and arm 26*b* respectively. In other circuit breakers of this class (2-pole and 3-pole) the link 28 is more complex, being made of a number of parts. In any case, the arm 26*b* of the handle and the link means 28 constitute a toggle which is slightly over-set (as shown) when the circuit breaker is closed. The finger-piece 26*c* of the handle engages the case and cannot move counterclockwise beyond the position illustrated; and for this reason the toggle 26*b*–28 cannot become overset beyond the degree illustrated. In this condition, handle 26 and link 28 drive the three-part device 12, 14, 16 counterclockwise to force movable contact 18 against companion contact 20. The middle of spring 24 is forced downward while its ends are restrained in the case, spring 24** thus becoming stressed.

When latch 16 releases actuator 14, toggle 26b–28 is no longer effective to hold the contact arm in its contacts-closed position. Upon release of the latch, spring 24 becomes freed to drive contact arm 12 counterclockwise about contacts 18, 20 as a fulcrum, providing initial impetus for the counterclockwise movement of the contact arm. Contact-opening spring 30 then pushes the contact arm counterclockwise about the pivot 24 the direction to open the contacts.

The overcurrent release device 16 includes an elongated bimetal 32. In the closed condition of the circuit breaker, a current path can be traced through the circuit breaker from terminal 22, through contacts 20 and 18, through a portion of contact arm 12 and along bimetal 32, to a flexible conductor 34 of fine-wire copper braid which is welded to the extremity of bimetal 32 and to external plug-in terminal 36. The bimetal is arranged so that, upon heating, the right-hand extremity of the bimetal moves downward in relation to the rest of the mechanism, this being the latch-releasing direction.

In its most widely used commercial form, the "heart" of this class of circuit breaker involves direct engagement of the actuator 14 with the free end of the bimetal (to the end to which the conductor 34 is connected). In other forms of this type of circuit breaker mechanism, the bimetal is arranged to operate a latch separate from the bimetal, and some form of magnetic operator is also provided for deflecting that separate latch for releasing the circuit breaker under short-circuit conditions. However, in those instances in the past when so-called "sensitive" magnetic tripping was desired, it always seemed to be necessary to incorporate a coil as part of an electro-magnet in series with the conductive path through the circuit breaker. Such a coil adds considerably to the expense and complexity of circuit breakers. Here, without using a trip coil, it has proved feasible to achieve high magnetic tripping sensitivity in this class of circuit breaker of the order of as little as five times the rated nominal tripping current. For example, a circuit breaker constructed pursuant to the present invention (as illustrated in the drawing) having a nominal current rating of 15 amperes, may be required to trip after a time delay in response to 30 amperes, and such a breaker can be made to trip at 75 amperes instantaneously using the disclosed construction.

Figure 2:
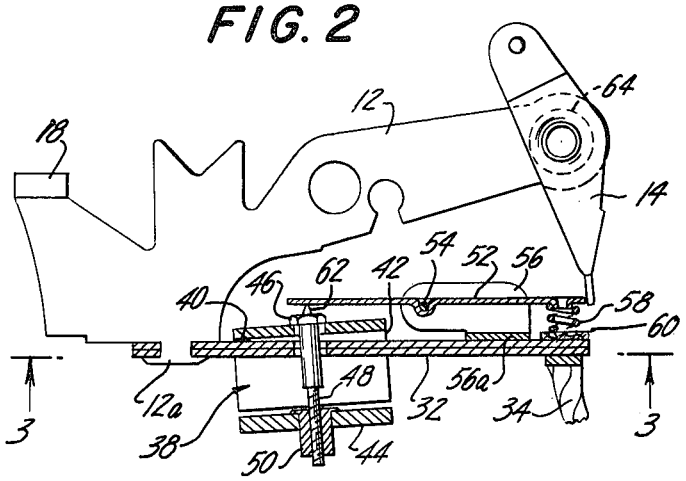
FIG. 2 is an enlarged view of portions of FIG. 1, shown partly in cross-section.
Figure 3:
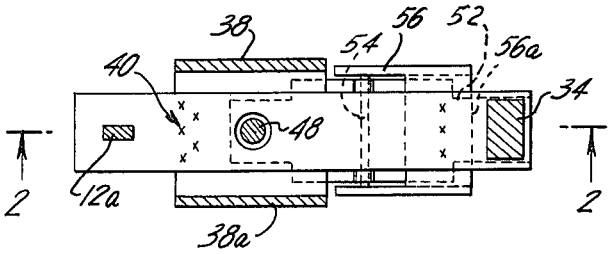
FIG. 3 is a cross-section of portions of FIG. 2 as viewed from the plane 3—3, FIG. 2.

Referring to FIGS. 2 and 3, the details of the overcurrent release 16 may now be considered. As seen in FIG. 2, contact arm 12 is united to one end of bimetal 32 by means of an integral rivet 12a, providing a low-resistance electrical connection and a secure mechanical connection between the contact arm and the bimetal. At its opposite end, the bimetal is united to braid 34 by welding. The walls 38a of a channel-shaped core 38 straddle the bimetal. The "bottom" or web of the core is disposed closely adjacent to the wide surface of the bimetal strip. Core 38 is resistance-welded to the bimetal at area 40 (represented by the small crosses). There is a slight space 42 between the bimetal and that portion of the core that is remote from the welded area 40. (Space 42 is exaggerated in FIG. 2.)

Flat armature 44 is separated by small gaps from the edges of side walls 38a. A composite rod maintains assembly of armature 44 to core 38. This rod includes a hexagonal head portion 46 which rests on core 38, and a rod 48 that is threaded along part of its length. This threaded portion extends through an internally threaded bushing 50 that is united to armature 44. The gaps between armature 44 and the side walls of core 38 are adjusted by rotating the hexagonal head 46 of the rod, and thereafter bushing 50 is crimped against the rod to resist any change of adjustment such as might otherwise result from vibration.

A latch lever 52 is pivoted roughly midway between its ends on a shaft 54 which is, in turn, supported by a bracket 56. This bracket includes two side walls that carry the ends of shaft 54. The side walls of the bracket are connected by a web 56a that is welded to bimetal 32. A coil spring 58 biases the right-hand arm of latch lever 52 upward. Coil spring 58 bears downward against a piece of insulation 60 that is adhered to bimetal 32. The left-hand arm of latch lever 52 is engaged by a slight projection 62 of rod 46–48. Spring 58 biases latch lever 52 counterclockwise and accordingly biases rod 46, 48 downward so as to bias armature 44 away from core 38.

During periods of moderate overcurrent flowing through the bimetal 32, the bimetal deflects downward, and carries bracket 56 and pivot 54 downward. Inasmuch as projection 62 supports the left-end extremity of latch lever 52, the right-end extremity of the latch lever moves downward and unlatches actuator 14. When this occurs, spring 30 pushes contact arm 12 counterclockwise. Actuator 14 moves clockwise about its pivot. Contacts 18 and 20 are opened. When there is a short-circuit or a current of sufficient magnitude to cause armature 44 to move against core 38, rod 46–48 shifts upward and drives latch lever 52 clockwise about its pivot 54. This releases actuator 14 and the contact arm is driven counterclockwise as before to open the contacts.

The only current path through the overcurrent release 16 is that which is carried along bimetal 32. Insulator 60 prevents current from flowing through coil spring 58 and latch lever 52. Moreover, there is an insulating bushing 64 in the pivot of actuator 14 on contact arm 12; and this insulation prevents flow of any current from the bimetal through rod portion 46 and latch lever 52 to actuator 14.

The combined thermal and magnetic tripping device 16 is of remarkable magnetic sensitivity, considering the fact that no coil is needed. The cost of such a coil and the inherent complexity of a coil are eliminated. The entire tripping device 16 is compatible with the requirement in this class of circuit breaker that the "heart" comprising parts 12–14–16 must be operated clockwise as a unit when the circuit breaker is manually closed. Trip unit 16 and movable contact arm 12 have a very small moment of inertia and move at high speed to interrupt an overcurrent or a short-circuit when the contacts open. This circuit breaker can have a current-interrupting rating of 3,000 amperes at 415 volts, and it can trip at 5 times its rated current, with rated currents as low as 15 amperes. This breaker can be made as an "L" characteristic unit to VDE 0664 (German Standard).

As is well known, this circuit breaker (in common with usual circuit breakers) is trip-free, so that the contact-opening operation of the contact arm when actuator 14 is unlatched is not in any way impeded if the handle is pressed to remain in the "on" position illustrated. However, if the handle is not restrained, the handle is moved by spring 30 to the "off" position when the contact arm is driven to its "off" position. Additionally, even though actuator 14 is momentarily driven clockwise when it is unlatched, actuator 14 quickly moves counterclockwise when the handle moves to the "off" position. Actuator 14 is then in condition to become relatched against latch lever 52 at the start of a subsequent circuit-breaker closing operation of the handle.

What is claimed is:

1. A circuit breaker of the type having a case of molded insulation and a mechanism including:

a pivoted unit mainly comprising an elongated contact arm having a pivotal support between the ends thereof and having a movable contact at one end thereof, an actuator pivoted to the opposite end of the contact arm, and an overcurrent release device constituting latching means for said pivoted actuator, said release device including a short-circuit responsive electromagnet and an elongated overcurrent responsive bimetal fixed at one end thereof to the contact arm, a handle pivoted in said case and link means articulated to said actuator and acting with said handle to form an operating toggle for said pivoted unit, an opening spring biasing the contact arm in the opening direction and, a companion contact engageable by said movable contact when the handle is operated to close the circuit breaker, that improvement wherein said electromagnet comprises a core and an armature encircling the bimetal, said core being fixed to said pivoted unit adjacent said fixed end of the bimetal, means supporting said armature at the side of the bimetal remote from the contact arm and said supporting means limiting the gap between said core and said armature, and a medially pivoted latch lever carried by said bimetal and disposed between the bimetal and the contact arm, one end of the latch lever acting as a latch normally obstructing said actuator and the opposite end of the latch lever being operated by said armature all arranged so that overcurrent in the bimetal causes displacement of the pivot and the latch end of the latch lever to release the actuator and so that short-circuit current in the bimetal causes pivoting of the latch lever to release the actuator.

2. A circuit breaker as in claim 1, including a spring biasing the latch lever into its actuator-latching position and biasing the armature away from the core.

* * * * *